US005496192A

United States Patent [19]

Hower et al.

[11] Patent Number: 5,496,192

[45] Date of Patent: Mar. 5, 1996

[54] CROSS-CONNECTION MODULE PROVIDING FOR UNINTERRUPTIBLE TRANSMISSION DURING SERVICING

[75] Inventors: James S. Hower, Harrisburg; Maris A. Glass, York; Clyde T. Carter, Shermans Dale; James W. Robertson, Oberlin, all of Pa.

[73] Assignee: The Whitaker Corporation, Wilmington, Del.

[21] Appl. No.: 325,004

[22] Filed: Oct. 18, 1994

[51] Int. Cl.[6] ..... H01R 4/24

[52] U.S. Cl. ..... 439/409; 439/411

[58] Field of Search ..... 439/402, 403, 439/409–413, 709–713, 724, 725

[56] References Cited

U.S. PATENT DOCUMENTS

| | | | |
|---|---|---|---|
| 3,777,223 | 12/1973 | Chandler et al. | 317/118 |
| 4,210,378 | 7/1980 | Baribeau | 439/397 |
| 4,283,104 | 8/1981 | Pemberton | 439/395 |
| 4,283,105 | 8/1981 | Ferrill et al. | 439/406 |
| 4,431,247 | 2/1984 | Abdullah et al. | 439/392 |
| 4,795,363 | 1/1989 | Sherer et al. | 439/409 |
| 5,006,077 | 4/1991 | Loose et al. | 439/409 |
| 5,006,077 | 4/1991 | Loose et al. | 439/409 |
| 5,219,302 | 6/1993 | Robertson et al. | 439/403 |
| 5,254,015 | 10/1993 | Robertson | 439/410 |

*Primary Examiner*—David L. Pirlot
*Assistant Examiner*—Jill DeMello
*Attorney, Agent, or Firm*—Anton P. Ness

[57] ABSTRACT

A cross-connection assembly (10) including a plurality of cross-connection sites (14) provided by housing modules (30) secured to a base frame (12). Each site (14) is defined by a silo (52) containing a first terminal (60) and an actuator (120) secured thereatop rotatable to terminate a first wire (112) to the first terminal. At a selected site, a second terminal (160) is mountable to the actuator (120) thereat to electrically engage the first terminal, and a corresponding cap (190) over the second terminal is initially rotatable with respect to actuator (120) in order to terminate a second wire (220) at the site. Upon the first rotation the cap becomes locked to the actuator, providing that later rotation of the cap also moves the actuator and second terminal and second wire of necessity to permit untermination and retermination of the first wire (112) with respect to the first terminal (60).

32 Claims, 9 Drawing Sheets

CROSS-CONNECTION MODULE PROVIDING FOR UNINTERRUPTIBLE TRANSMISSION DURING SERVICING

FIELD OF THE INVENTION

The present invention relates to electrical connections and more particularly to electrical connections between pairs of discrete electrical wire conductors.

BACKGROUND OF THE INVENTION

In the telecommunications industry telephone cable is introduced to multi-line customers at a single location or junction. An end of a multiple-conductor cable is prepared for ends of the respective discrete cables to be manipulated for interconnection with ends of respective discrete cables of the customer in an organized array by a multi-site distribution block or module. The module defines individual cross-connection sites wherein discrete terminals are housed within insulative housing sections, in a manner permitting ends of wires to be inserted into apertures of the housing sections to be electrically connected to the terminals. Each telecommunications cable conventionally contains a pair of conductors, termed tip and ring wires of a twisted pair cable, and the tip wire of each customer's cable must be connected to the tip wire of the respective distribution cable for each customer line, as well as the customer cable ring wire connected to the ring wire of the distribution cable; each cross-connection site contains a pair of terminals individually housed adjacent each other for convenience, with each terminal dedicated to one of the tip wire or ring wire of the wire pair. Preferably the connections of the wire conductors to the terminals is mechanical rather than soldered, and is separable to permit easy servicing or reprogramming involving disconnection and either reconnection or replacement of at least the customer wires.

One such multi-wire cross-connection module is disclosed in U.S. Pat. No. 4,431,247 shown to provide for cross-connection of up to twenty-five lines using fifty separately-housed terminals arrayed in five rows and ten columns secured in housing sections joined to a common base. Pads are provided at ends of the base for supporting and arranging individual wires or bundles of wires that are to be connected, and the base is adapted to be mounted to a support within a cabinet. Ends of the distribution cable conductors are electrically connected to the respective terminals beneath the horizontal base during (or even before) initial installation of the module in the cabinet, while ends of the customer cable wires are to be later connected to upper ends of the terminals in cylindrical housing sections or silos above the base. Connection of each of the customer cable wires is accomplished by insertion of the still-insulated wire end into an aperture of a respective housing section and through the housing section to extend beyond the far side, with portions of the wire extending through apertures of the terminal. An insulative cap member secured around the housing section is then rotated in a manner that presses the wire into a lateral slot of the terminal adjacent the insertion aperture while shearing off the free end portion of the wire extending beyond the wire exit aperture. An opening into the top of the cap permits insertion of a test probe engageable with a horizontally oriented contact tab to provide testing for assurance of a successful cross-connection.

Another approach to multi-cable cross-connection modules is disclosed in U.S. Pat. No. 4,210,105 wherein an insulated wire end section is pressed downwardly into vertical slots of the terminal and its free end trimmed, after which a screw member is threaded into the terminal to secure the wire in position. Other earlier approaches include wrapping of stripped wire ends about binding posts.

U.S. Pat. No. 5,006,077 discloses a terminal block having housing sections for a plurality of terminals for interconnecting pairs of wires. Two terminal members cooperate for terminating a customer cable conductor to a distribution cable conductor, with one of the terminal members being stationary while the other is in electrical engagement therewith and is rotated by an actuator after an insulated wire end has been inserted into an aperture of the housing section and through opposed openings of the rotatable terminal member until the wire free end reaches a stop within the housing section. Rotation of the rotatable member causes edges of at least one lateral slot of the terminal to be urged into engagement with the insulated wire to penetrate the insulation to establish assured electrical connection with the conductor of the wire. With smaller diameter wire, the wire extends completely through a center post of the housing section within the barrel-shaped terminal and slightly beyond the opposed side of the terminal remote from the wire entry aperture so that facing edges bounding a smaller dimension lateral slot penetrate the insulation to establish electrical connection, while edges along a larger dimension slot proximate the wire entry aperture merely compress the wire insulation to define a strain relief. The arrangement is shown to provide for a pair of wires to be so terminated and connected to an associated conductor of a stub cable beneath the terminal block that extends elsewhere for connection to the distribution cable.

In U.S. Pat. No. 5,219,302 is disclosed a cross-connect module in which a pair of terminals are housed in respective silos for termination to tip wires and ring wires of an individual customer cable to a distribution cable, with the terminals being rotatable for termination to insulated wire ends similarly to the disclosure of U.S. Pat. No. 5,006,077.

It is desired to provide a cross-connection system for cross-connecting an array of customer cables to a distribution cable at a common location, in a system that permits connection of alternate wires to the stationary terminal and thus to the distribution cable, after the primary wires of the customer cables have been installed and in service, in order to provide uninterrupted transmission service to the customer during repairing or servicing of the junction that requires temporary disconnection of the primary customer cable wires.

It is also desired to provide increased wire management area to the cross-connection array, providing greater clearance for placement of the wires within the array among the silos and from the respective cross-connection sites to the wire management fins at ends of the rack, while maintaining the existing spacing between the cross-connection sites.

It is further desired to provide for such cross-connection arrays to be spaced closely together.

SUMMARY OF THE INVENTION

The present invention provides a modular terminal block for cross-connecting the tip and ring wires of an array of primary customer cables to respective cables of the distribution cable of the telecommunications service company at a junction to establish primary customer telecommunication service, where the modular terminal block facilitates the process of terminating the conductors of a stub cable to respective terminals, defining a cable harness where the stub cable extends to a remote site for splicing to associated conductors of the distribution cable and the cross-connection array is ready to be mounted in a cabinet. The cross-connection array is adapted to be spaced closely to adjacent arrays in a cabinet, and each silo of the array is designed to be reduced in overall horizontal dimension permitting greater wire management area between silos.

In another aspect, the present invention further provides for the cross-connection of secondary tip and ring wires of the customer, at selected ones of the cross-connection sites for the corresponding primary tip and ring wires, without disturbing the cross-connection of the primary tip and ring wires to the corresponding wires of the distribution cable. An actuator is movable in a first direction to relatively move a primary wire with respect to an associated first terminal; a second terminal within a cap member is securable to the actuator to engage the first terminal and is movable in the first direction by actuation of the cap member to move a secondary wire with respect to the second terminal, terminating the secondary wire thereto and also locking the cap member with respect to the actuator. In the locked condition moving of the cap member in the reverse direction serves to move the actuator and second terminal along with it and to unterminate the primary wire from the first terminal while preserving the termination of the secondary wire to the second terminal and electrical continuity to the first terminal and the distribution wire; the cap member is then later movable in the first direction to reterminate the primary wire (or its replacement) to the first terminal.

A base frame includes wire management fins at ends thereof, and a plurality of modules are securable to the base frame, with each module having a plurality of pairs of housing silos containing terminals therein and defining cross-connection sites. The wire management fins at a first end are positioned relatively higher, permitting receipt thereunder of wire management fins of an adjacent like assembly. The modules include tabs along one side and corresponding tab-receiving recesses along the opposed side, for close spacing of the modules in the base frame and providing a means for polarizing the modules to assure that the wire-termination features of all the silos of the array are facing a common direction.

Actuators enable electrical connection of ends of discrete wires to the terminals upon insertion of the ends into wire-receiving recesses of the silos at the upper ends thereof and through wire-receiving apertures of the terminals. After wire insertion, rotation of the actuator in a first direction urges the wire into a wire-terminating slot of the terminal so that edges of the slot penetrate the wire insulation and establish electrical connection with the conductor therewithin. Actuators are placed only over upper ends of the silos and first terminals, allowing clearance between the bottom of the actuators and the base sections of the modules for better access and visual inspection of the wires extending between the silos from respective cross-connection sites to the wire management fins.

In a preferred embodiment of this aspect of the present invention, at any selected cross-connection site, a second terminal is securable atop the actuator thereat, with a first contact section thereof received through an arcuate slot into the top of the actuator and into spring biased engagement along an inwardly facing surface of the top of the stationary terminal to become electrically engaged therewith. A cap member is then securable over the second terminal and includes an aperture into the side wall thereof aligned with a second contact section of the second terminal. The cap member serves as an actuator for the second terminal and is securable onto the actuator by latches to the top of the actuator and all in a manner that permits rotation of the cap with respect to the actuator in the same direction as the first direction followed by the actuator to terminate the primary tip or ring wire to the stationary terminal. The rotation of the cap urges the secondary tip or ring wire into an insulation displacement slot of the second terminal, thereby electrically connecting the secondary wire to the second terminal, and thus to the stationary terminal and the stub cable and eventually the distribution wire. Full rotation of the cap during secondary wire termination causes locking members within the cap to ride over cam surfaces along the outer surface of the actuator and lock behind ledges at ends of the cam surfaces.

Following cross-connection of the tip and ring wires of a secondary customer cable to the distribution wires of the appropriate distribution cable, the primary tip and ring wires may be removed from their cross-connection sites by rotation of each cap in the opposite or second direction, which effectively also rotates the respective actuators in the same second direction because of the locking members locked behind the ledges of the actuators, which in turn urges the primary wires out of their terminated condition with respect to the stationary terminal permitting removal of the primary wires for servicing.

It is seen that the present invention also defines an electrical connector, when one considers an individual housing silo, its first and second terminals, and the actuator and the cap member, providing for insulation displacement termination of a first wire to the first terminal, and that provides for the subsequent termination of a second wire to the second terminal and thus commoning thereof to the first terminal and the first wire while permitting removal of the first wire and replacement.

It is an objective of the present invention to provide a system for assuring uninterrupted service to the customer during repair and servicing procedures.

It is also an objective of the present invention to permit termination of secondary tip and ring wires to appropriate terminals to which the primary tip and ring wires are terminated while not disturbing the terminations of the primary wires.

It is a further objective to enable later removal of the primary wires from the cross-connection sites after the secondary wires have been cross-connected thereat, and thereafter retermination of the primary wires, without disturbing the terminations of the secondary wires.

It is also an objective of the present invention to provide a cross-connection array that provides for being spaced closely with respect to adjacent arrays.

It is an additional objective to provide greater clearance between cross-connection sites within the array.

It is further an objective to provide modules of several cross-connection sites to be mounted to a common rack to define the overall large array of such sites, facilitating wiring of the conductors of the stub cable by permitting a module found after wiring and during testing to contain a defective terminal, to be discarded without requiring untermination of all wires previously terminated to other modules of the rack.

An embodiment of the present invention will now be described by way of example with reference to the accompanying drawings.

DETAILED DESCRIPTION OF THE PREFERRED EMBODIMENT

Figure 1:
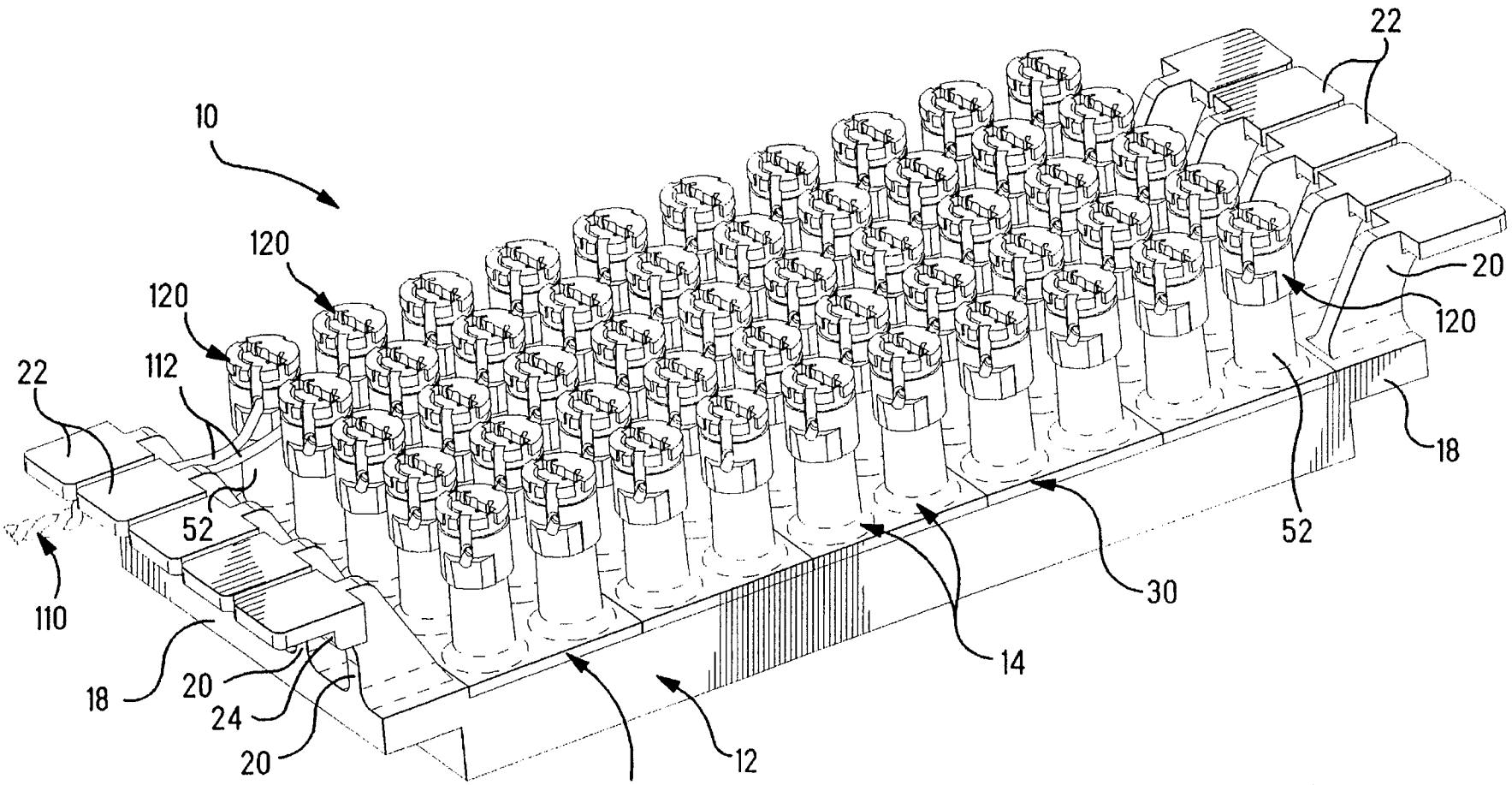
FIG. 1 is an isometric view of a cross-connection assembly with which the present invention is used, showing a representative pair of primary wires of a customer cable.

FIG. 1 shows a complete cross-connection assembly 10 having a base frame 12 and five housing modules 30 with actuators 120 assembled thereto. The assembly is shown to define fifty cross-connection sites 14 for cross-connecting twenty-five twisted pair customer cables 110 one of which is shown, having a pair of primary wires 112. A pair of apertures 16 (FIG. 2) are provided at each end 18 of base frame 12 for receipt of a fastener (not shown) therethrough for mounting to a panel of a junction box (not shown). A plurality of wire management fins 20 is arrayed along each end 18 of base frame 12. Horizontal pads 22 of fins 20 along one end are elevated with respect to those along the opposite end, providing clearances 24 for receipt thereunder of the horizontal pads of the fins of an adjacent base frame and permitting close spacing.

Figure 2:
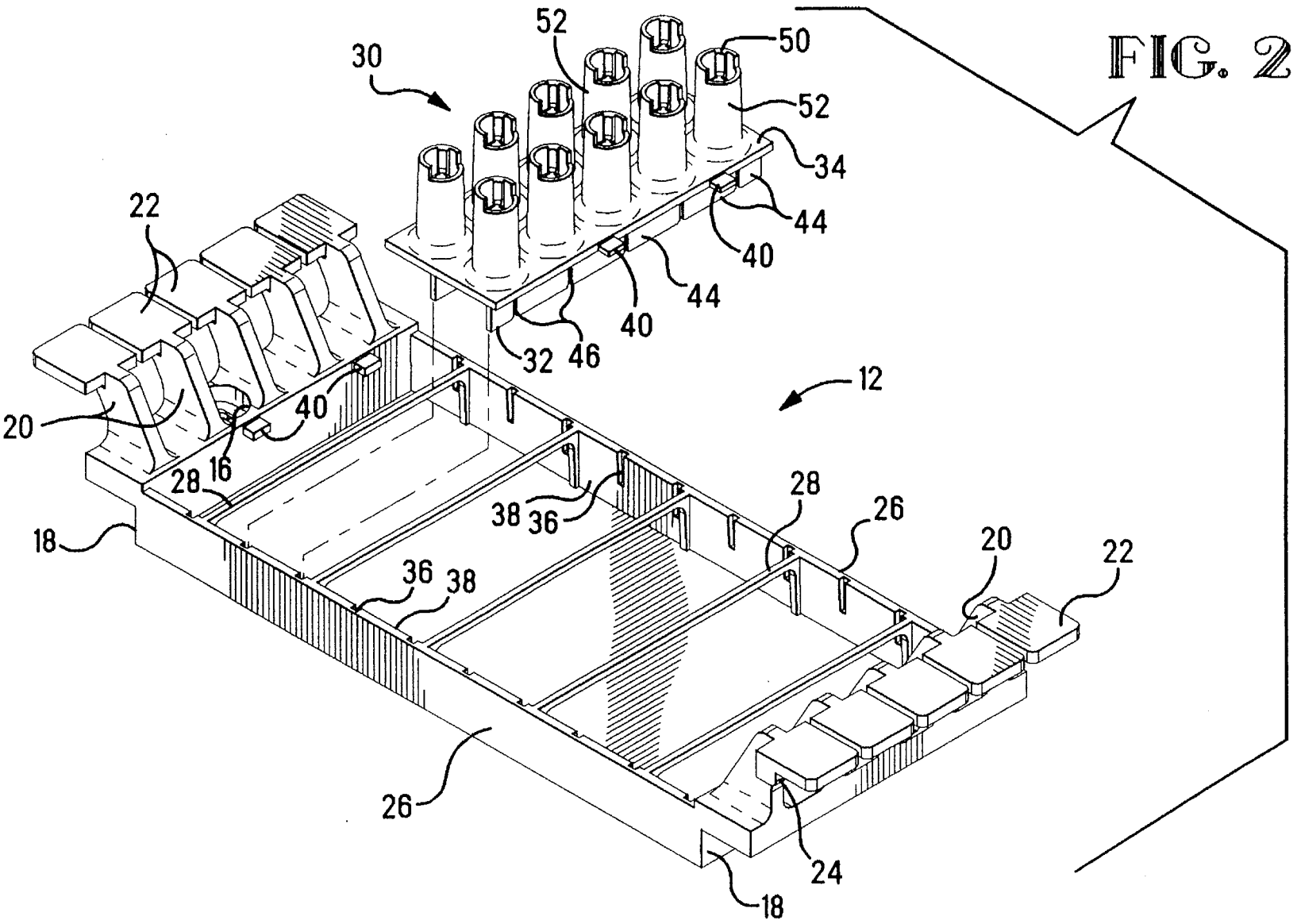
FIG. 2 is an isometric view of the base frame of the assembly of FIG. 1 with a housing module shown exploded therefrom and positioned to be inserted and secured in position in the base frame.
Figure 3:
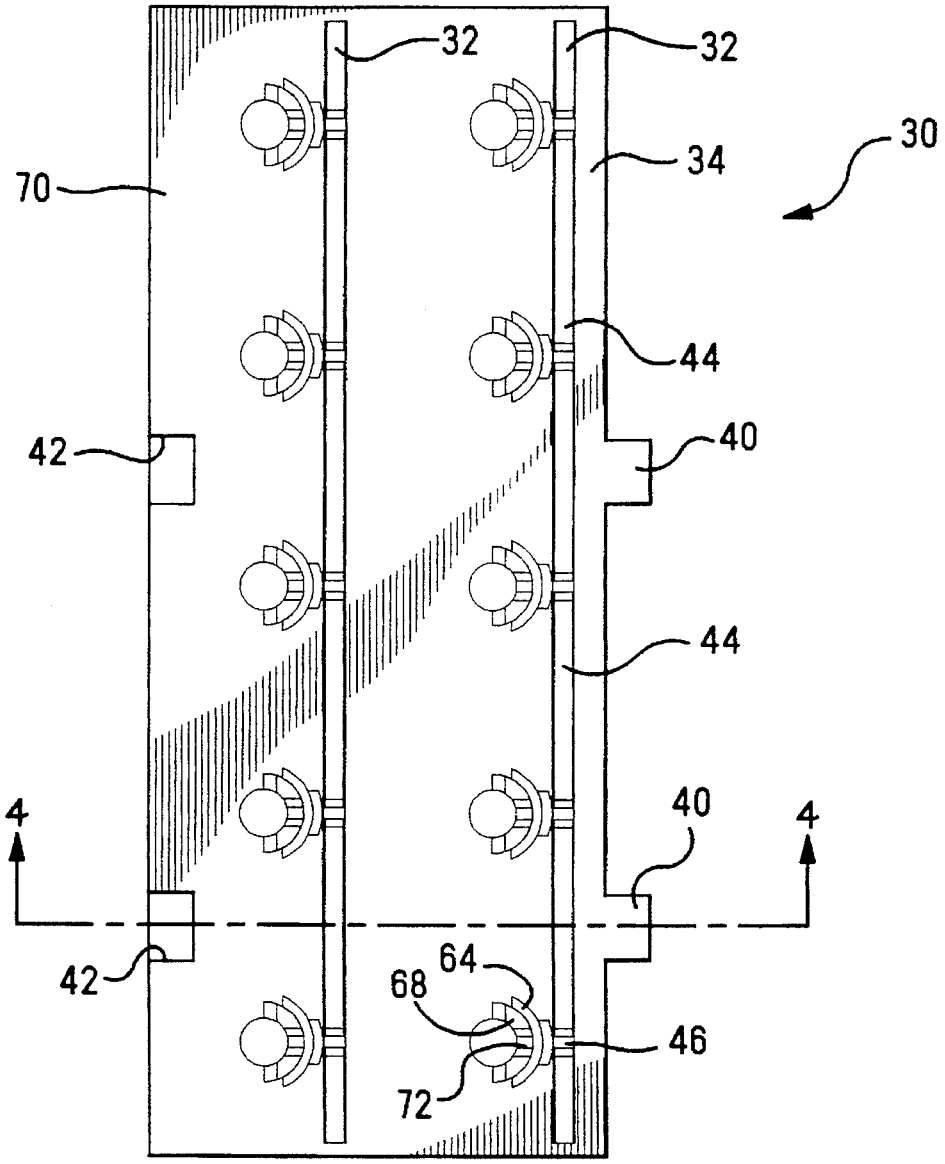
FIGS. 3 and 4 are a bottom view and a cross-sectional view of a housing module of FIG. 2, with FIG. 4 taken along lines 4—4 of FIG. 3.
Figure 4:
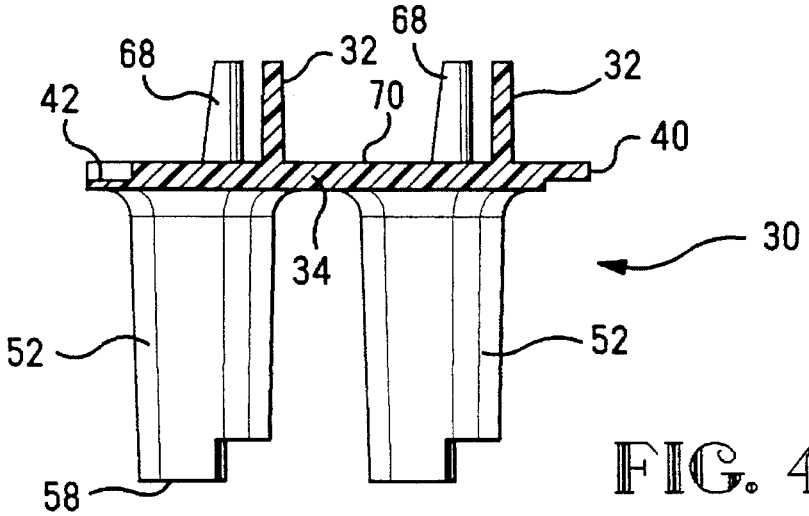
Figure 6:
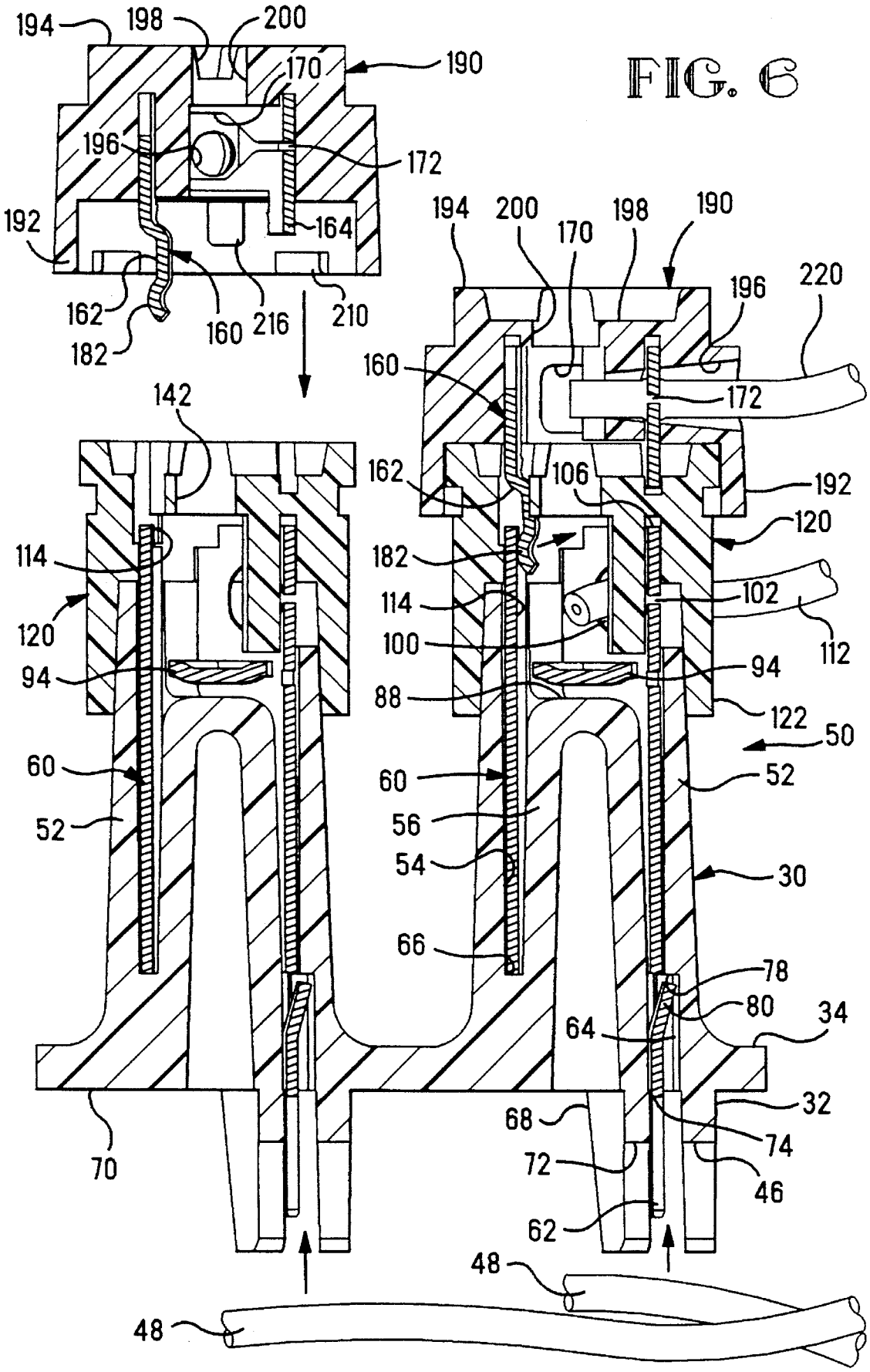
FIG. 6 is a longitudinal section view of a pair of connection sites of the housing module assembly of FIGS. 1 and 5, one with primary and secondary wires terminated, and the other with a second terminal and cap subassembly positioned to be assembled thereonto.
Figure 7:
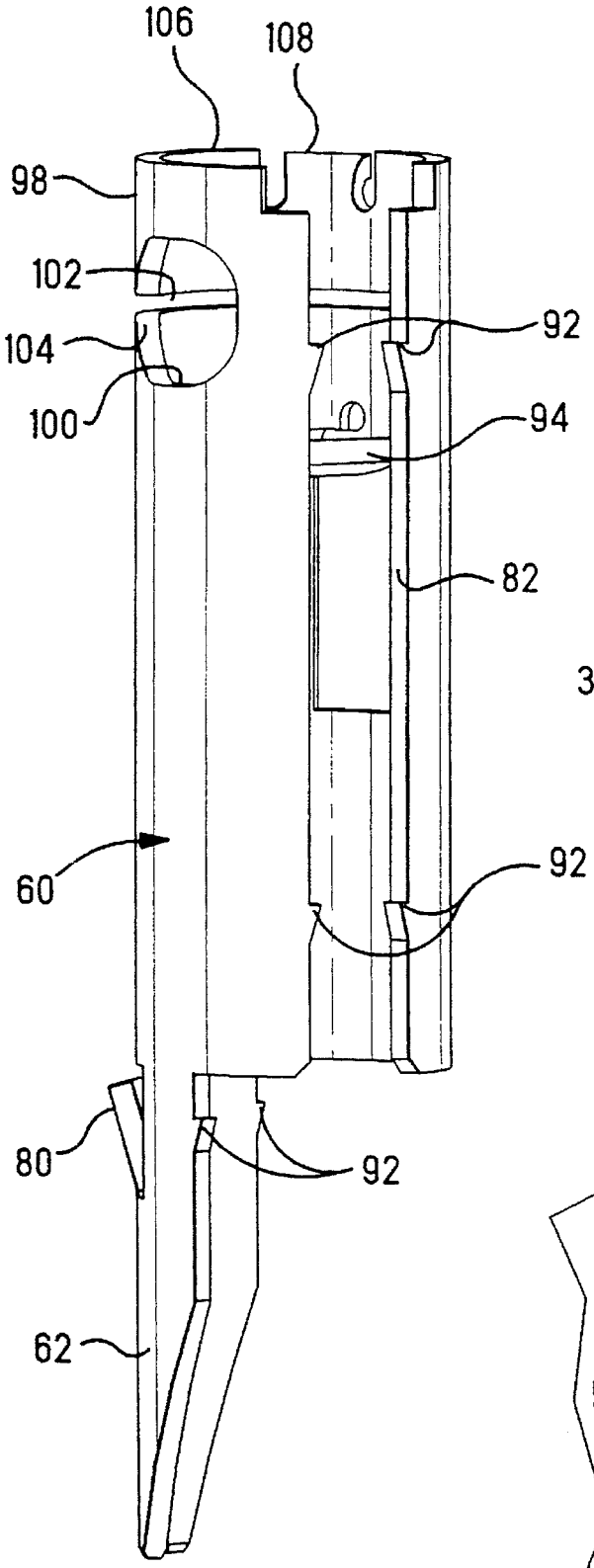
FIG. 7 is an enlarged isometric view of the stationary terminal of FIG. 6.
Figure 8:
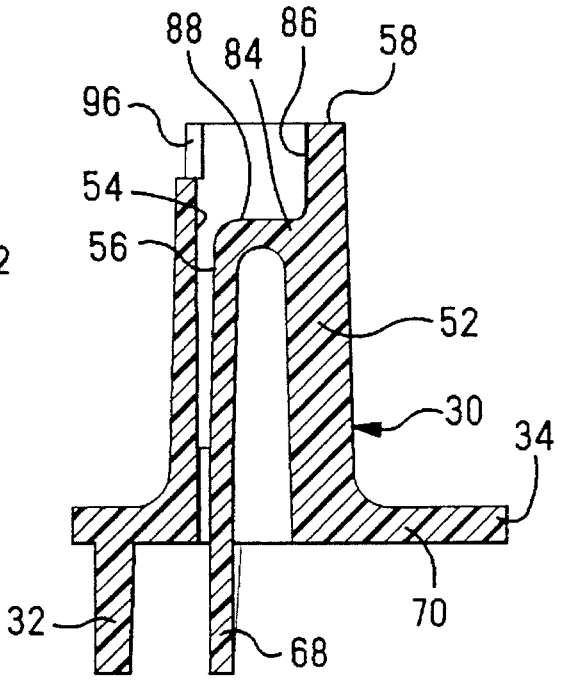
FIG. 8 is a longitudinal section view of a silo for the stationary terminal, taken along lines 8—8 of FIG. 5.
Figure 9:
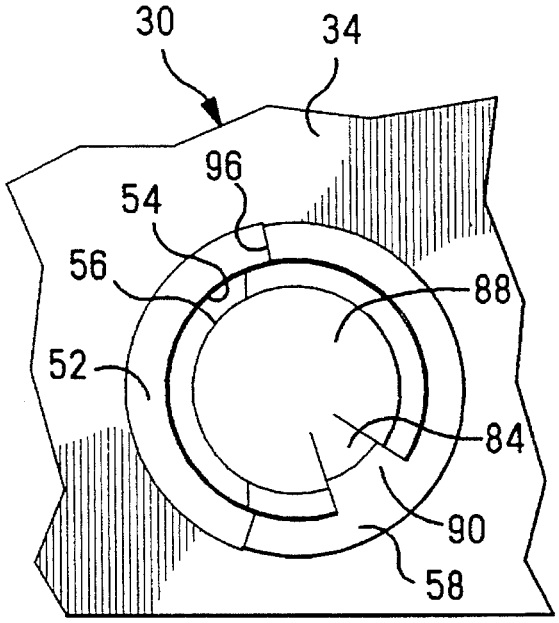
FIG. 9 is an enlarged plan view of the silo of FIG. 8.

Base frame 12 is shown in FIG. 2 to have locations for five housing module assemblies along side walls 26 between struts 28, with a housing module 30 of one thereof positioned to be secured to its location on the base frame atop and between a pair of struts 28. Each housing module 30 is securable to base frame 12 by ends of depending flanges 32 of module base section 34 being force-fit, for example, into complementary vertical slots 36 along inside surfaces 38 of side walls 26 of base frame 12. Horizontal tab-like keys 40 extend from module base section 34 along one side (and from one end 18 of base frame 12) to be received into complementary keyways 42 (FIG. 4) defined in the bottom surface of the base section of an adjacent housing module (and into the other end of base frame 12). Flange portions 44 are defined along depending flanges 32 separated by wire-receiving slots 46 for the conductor wires 48 (FIG. 6) of the stub cable to be urged thereinto during termination to the stationary or first terminals 60 (FIG. 6). Thereafter, potting material is preferably deposited to fill the bottom of base frame 12 to embed and seal the stub cable wires and the terminations to the first terminals, and which also serves to firmly affix the housing module assemblies to the base frame.

Figure 5:
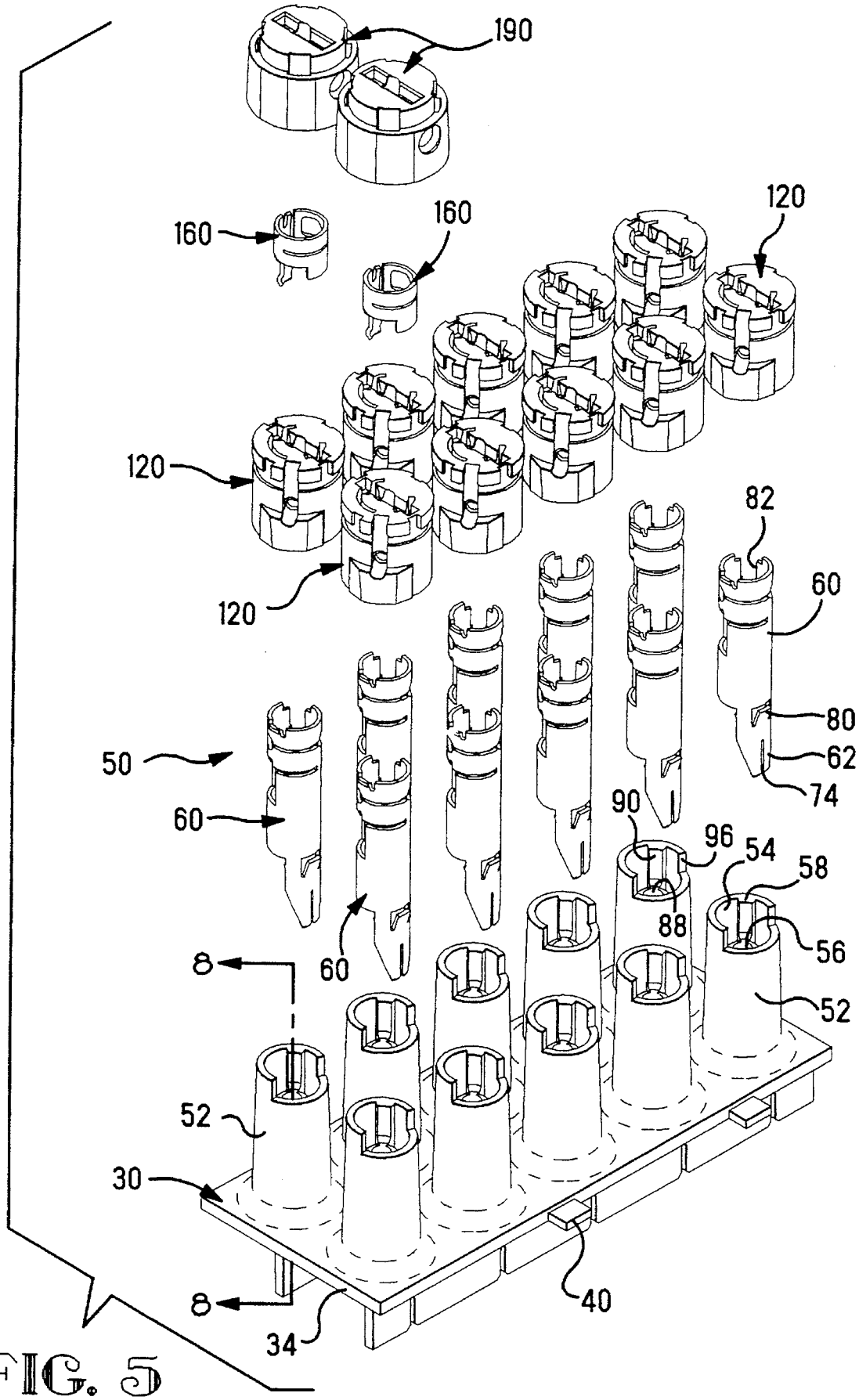
FIG. 5 is an exploded isometric view of a housing module assembly of the present invention with the stationary terminals and associated actuators exploded from respective silos and a representative pair of caps and second wire terminals exploded thereabove.

Referring to FIGS. 5 and 6, each housing module assembly 50 includes a housing module 30 having a plurality of housing sections or silos 52 extending upwardly from a module base section 34; housing module 30 is shown to have ten silos 52 defining ten cross-connection sites 14 to accommodate cross-connections of five customer cables. As can be seen, actuators 120 are positioned at the tops of the silos, well spaced from the base sections, and between adjacent ones of silos 52 are U-shaped channels providing generous wire management clearances, facilitating visual inspection and manipulation of wires routed between the silos and to the wire management fins following termination at respective cross-connection sites. Each silo 52 defines an annular cavity 54 substantially surrounding a center post 56, into which a first terminal 60 is insertable from silo entrance 58 to be disposed around center post 56. An actuator 120 is securable atop each silo 52 following placing of first terminal 60 into annular cavity 54. A second terminal 160 is then able to be positioned above actuator 120, and an insulative cap 190 is able to be placed over second terminal 160 and secured atop actuator 120.

First contact section 62 of first terminal 60 is associated with a respective wire 48 of a stub cable, and during assembly is urged through complementary arcuate slot 64 through cavity bottom 66 to be disposed between an arcuate wire support 68 extending beneath bottom face 70 of module base section 34, and depending flange 32. Arcuate wire support 68 includes a wire-receiving slot 72 thereinto aligned with a respective one of slots 46 of depending flange 32 and with insulation displacement slot 74 of first contact section 62, enabling a discrete wire 48 to be urged upwardly into the aligned slots 46,74,72 to be electrically connected with first contact section 62. Proximate bottom face 70 of module base section 30, arcuate slot 64 therethrough defines a downwardly facing latch surface 78 enabling outwardly and upwardly angled lance 80 of first terminal 60 to latch therebehind to retain first terminal 60 in housing silo 52; first contact section 62 within arcuate slot 64 prevents any rotation of first terminal 60 within silo 52 with respect to module base section 34, maintaining it stationary during rotation of actuator 120.

Referring to FIGS. 6 to 9, first terminal 60 is seen to be formed into a tubular shape having a vertical gap 82 between facing edges that corresponds with molded isthmus 84 joining center post 56 to side wall 86 of annular cavity 54 at top post surface 88; such a molded structure provides greater strength and facilitates and simplifies the molding of the desired small sized housing module 30. Isthmus 84 is disposed in vertical gap 82 of first terminal 60 and, along with key section 90 aligned therewith and extending to silo entrance 58, effectively defines a polarization system for proper insertion of first terminal 60 into annular cavity 54 so that first contact section 62 is aligned with arcuate slot 64. Barbs 92 along facing edges of gap 82 bite into the plastic material along sides of isthmus 84 therealong, with barbs 92 also on side edges of first contact section 62, all assisting in the retention of first terminal 60 in silo 52. A horizontal tab section 94 is formed from first terminal 60 to overlie top post surface 88 for engagement by a test probe (not shown) upon insertion through cap 190 and actuator 120 from above during testing, and top post surface 88 provides against overdeflection and overstress of horizontal tab section 94 during probing.

A large notch 96 is formed partially around silo entrance 58, extending circumferentially for about 100° for a wire to be urged circumferentially an arcuate distance of 100° by the actuator to be urged into electrical connection with a second contact section 98 of first terminal 60. Second contact section 98 comprises a wire-receiving aperture 100 adjacent notch 96 and an insulation displacement slot 102 extending circumferentially from an entrance 104 in communication with aperture 100, with slot 102 having a width incrementally less than the diameter of the conductor within the wire in order to penetrate through the wire's insulative jacket and enter into compressive engagement with the conductor but not damaging the conductor, when actuator 120 is rotated in a first direction (clockwise) from a first position to a second position relative to the silo and first terminal, to urge the wire into the entrance to the slot 102.

At top edge 106 of stationary first terminal 60 an actuator retention tab 108 has been shown bent outwardly to extend an incremental distance to seat overtop a ledge 144 (FIG. 11) of actuator 120 following placement of actuator 120 onto silo 52 after first terminal 60 has been secured in annular cavity 54. Actuator 120 is shown in FIGS. 5, 6 and 10 to 12 and includes a cylindrical flange 122 depending from a top section 124 that is dimensioned to fit atop the upper section of silo 52 and also around second contact section 98 of first terminal 60, while an arcuate inner section 126 interfits within second contact section 98 adjacent wire-receiving aperture 100. A wire-receiving aperture 128 extends through cylindrical flange 122 and inner section 126 initially aligned with wire-receiving aperture 100 of first terminal 60 permitting insertion of an end of a primary customer wire thereinto. An embossment 130 is provided along the outer surface of cylindrical flange 122 beneath wire-receiving aperture 128; this enables a wire being directed toward aperture 128 from a height higher than aperture 128 due to practical necessity since silo 52 may be in the midst of other nearby silos preventing direct access, to be captured by groove 132 of top surface 134 and guided into aperture 128 and thus into wire-receiving aperture 100 of first terminal 60. The entrance to aperture 128 preferably is provided with a generous angle at the top to facilitate and not inhibit guiding of the wire end into the aperture, when primary wire 112 is oriented at a descending angle to the wire end (see FIG. 10).

Actuator 120 also includes a tool-receiving slot 136 along top surface 124 enabling rotation thereof, to urge a primary customer wire 112 into electrical engagement with stationary first terminal 60. A pair of arcuate slots 138,140 are seen extending into top face 124 of actuator 120, for receipt thereinto of first contact arm 162 and retention arm 164 respectively of second terminal 160, during assembly of second terminal 160 at a cross-connection site 14. Probe-receiving hole 142 extends into top face 124 and through actuator 120, for a test probe to be inserted at a cross-connection site to engage horizontal tab section 94 of first terminal 60.

Figure 13:
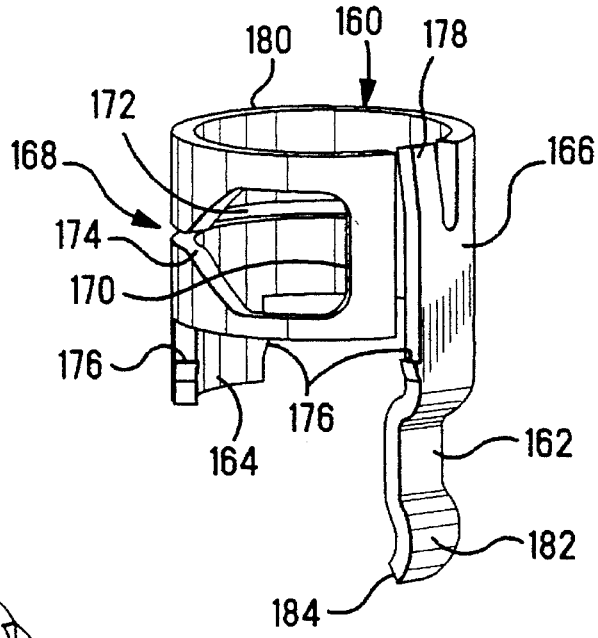
FIG. 13 is an enlarged isometric view of the second terminal of FIG. 5.

Second terminal 160 is best seen in FIG. 13, having a tubular body section 166 downwardly from which extend first contact arm 162 and retention arm 164. Second contact section 168 is seen to be similar to second contact section 100 of first terminal 60, and include a wire-receiving aperture 170, wire-terminating slot 172 extending circumferentially from entrance 174 communicating with aperture 170. Terminal-securing barbs 176 are placed on retention arm 164 and also on first contact arm 162, penetrating the walls of arcuate slots 138,140 of actuator 120 upon insertion of arms 162,164 of second terminal 160 fully thereinto to secure second terminal 160 to actuator 120, with tubular body section 166 extending above top face 124 thereof. An inwardly directed lance 178 is formed along top edge 180 of tubular body section 166 to cooperate with cap member 190 after assembly of the second terminal/cap subassembly to a selected cross-connection site and termination of a secondary wire 220 thereto, to polarize their respective positions during assembly and prevent relative rotation therebetween thereafter.

As seen in FIG. 6, first contact arm 162 of second terminal 160 includes a contact section 182 proximate free end 184, adapted to engage an inner surface 114 of first terminal 60 when second terminal 160 is fully assembled to actuator 120, with contact arm 162 spring biased outwardly against inner surface 114 to establish an assured electrical connection between second terminal 160 and first terminal 60. Contact section 182 of first contact arm 162 is adapted to bear against inner surface 114 when cap 190 is being rotated, carrying second terminal 160 with it, to re-rotate actuator 120 in a clockwise direction to terminate a replacement primary wire 112 to stationary first terminal 60.

Figure 14:
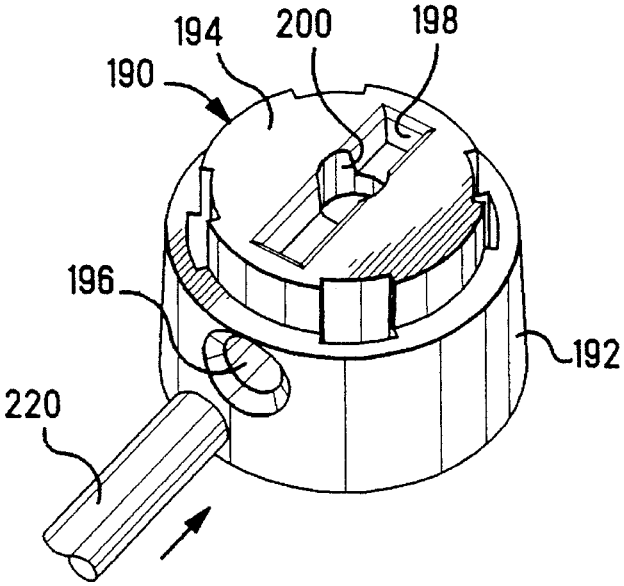
FIGS. 14 to 16 are enlarged isometric, section and bottom views of the cap of FIG. 5.
Figure 11:
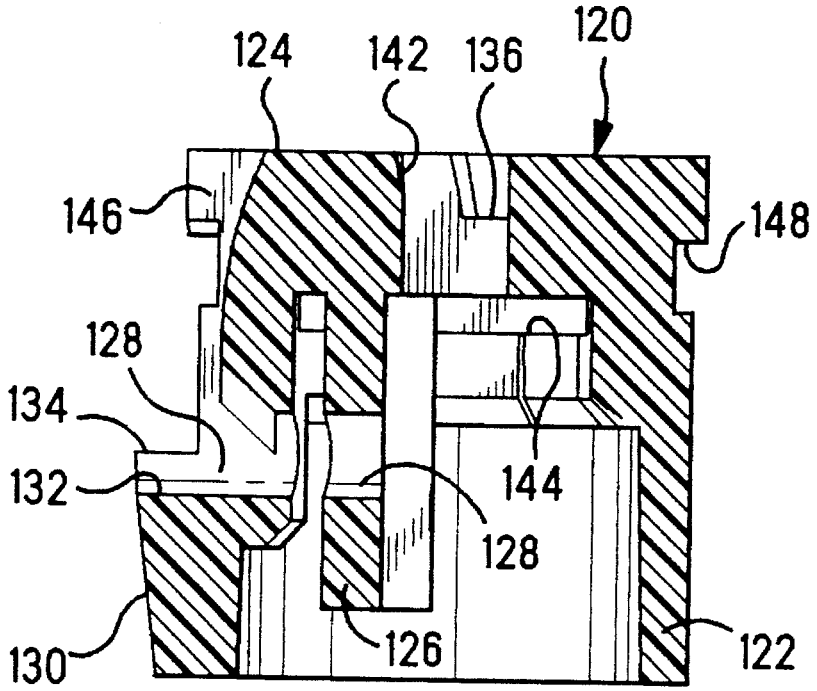
Figure 15:
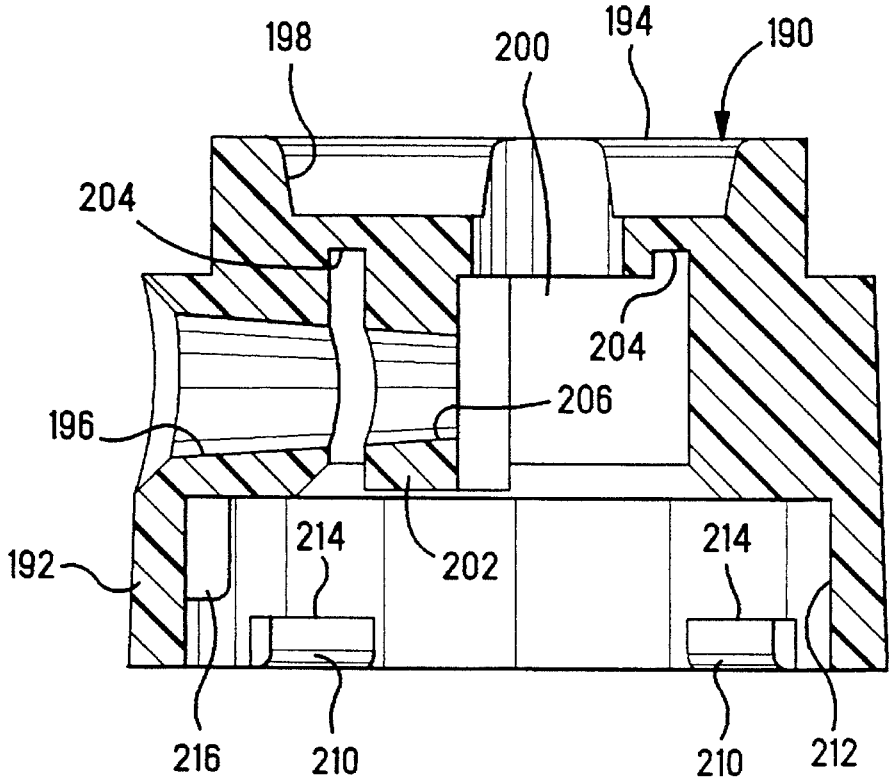
Figure 16:
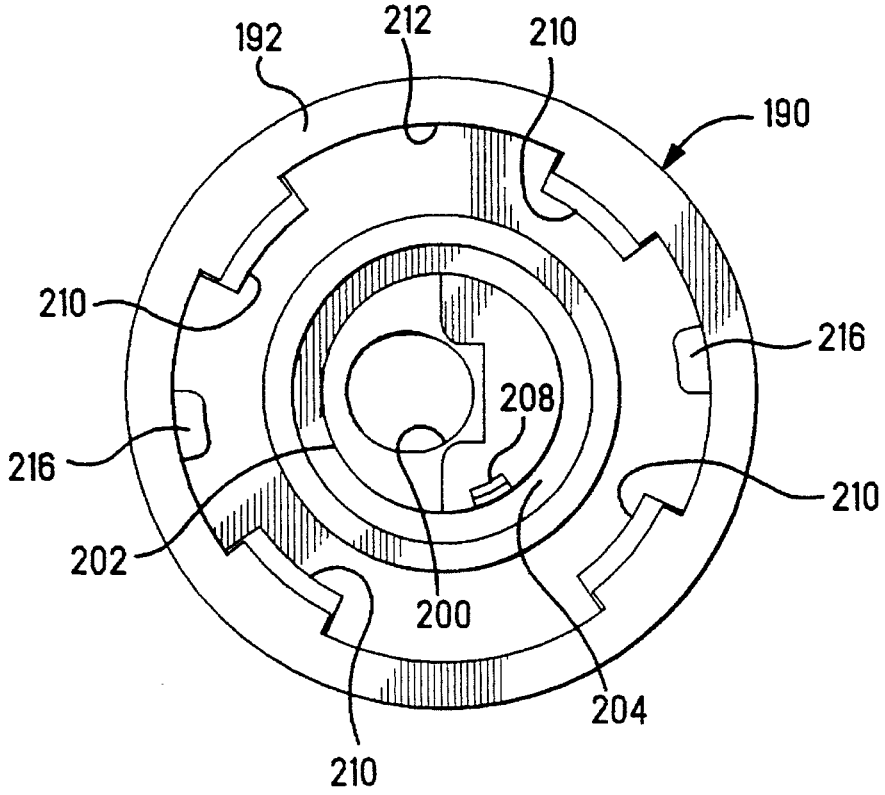

Referring now to FIGS. 14 to 16, cap 190 includes an outer annular flange 192 depending from top surface 194, with a wire-receiving aperture 196 through annular flange 192 and a tool-receiving slot 198 and approximately centered probe-receiving hole 200 into top surface 194. Within cap 190, as seen in FIG. 15, is an inner generally cylindrical flange 202 that is radially spaced from outer annular flange 192 to define an annular terminal-receiving cavity 204. Inner flange 202 includes an inner aperture 206 extending to probe-receiving hole 200 and aligned with and inwardly of wire-receiving aperture 196.

Second terminal 160 is preferably assembled to cap 190 to be manipulated as a unit, for assembly to a top face 124 of an actuator 120 of a selected silo 52. Top edge 180 of tubular body section 166 is inserted into terminal-receiving cavity 204 of cap 190 to fit tightly around inner cylindrical flange 202 thereof. Upon initial assembly of second terminal 160 to cap 190, lance 178 is spaced angularly from a lance-receiving slot 208 of inner cylindrical flange 202 the angular distance equivalent to the amount of rotation selected to terminate a secondary wire to second terminal 160, preferably about 100° ; upon rotation of cap 190 to terminate secondary wire 220, lance 178 will snap into lance-receiving slot 208 thereafter preventing any relative rotation between cap 190 and second terminal 160. It is preferred to provide sealant material within the cap and second terminal assembly; such sealant material may be a gel-like material as disclosed in European Patent Publication No. 0 529 957 A1. Also, preferably, such sealant material is placed within each silo 52 of housing module assemblies 50 embedding the surfaces of stationary first terminals 60 and, upon termination, primary tip and ring wire ends within the silos.

Four latch members 210 are shown spaced around the inner surface 212 of annular flange 192 and including upwardly facing latch surfaces 214. Latch members 210 are force fit over the slightly larger diameter periphery 146 of top face 124 and seat within annular groove 148 when cap 190 is assembled onto actuator 120. Latch members 210 are cooperable with the top wall of annular groove 148 to secure cap 190 to actuator 120 and enable cap 190 to be rotated with respect to actuator 120 by following annular groove 148.

A pair of opposed locking bosses 216 are also defined on inner surface 212 of annular flange section 192 of cap 190.

An array of four vertical notches 150,152 are provided in periphery 146 of actuator 120 (FIG. 8) and extend from top face 124 to annular groove 148, associated with locking bosses 216. The two locking bosses 216 are first seated within respective opposed first notches 150 and lock in opposed second notches 152 following an initial rotation of the cap member.

Figure 10:
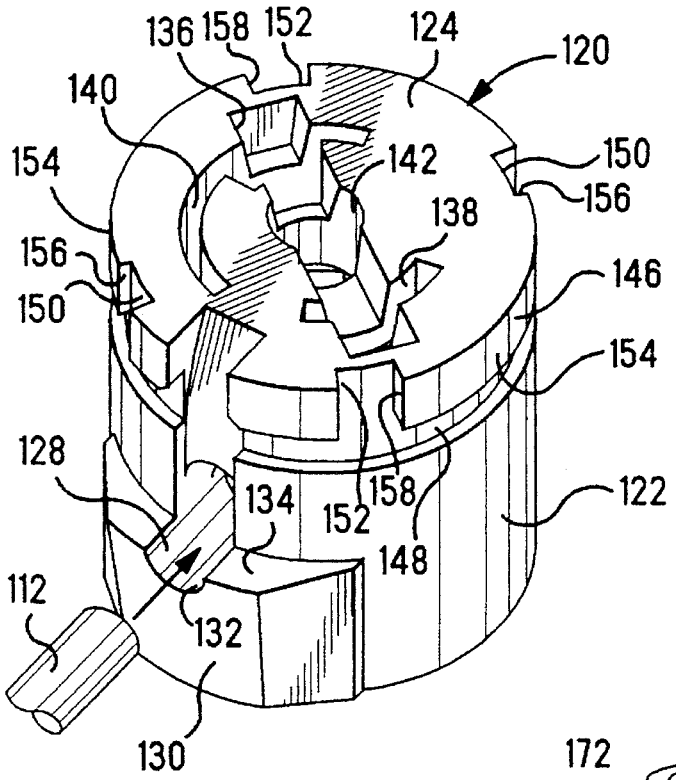
FIGS. 10 to 12 are enlarged isometric, section and plan views of the actuator of FIG. 5.
Figure 12:
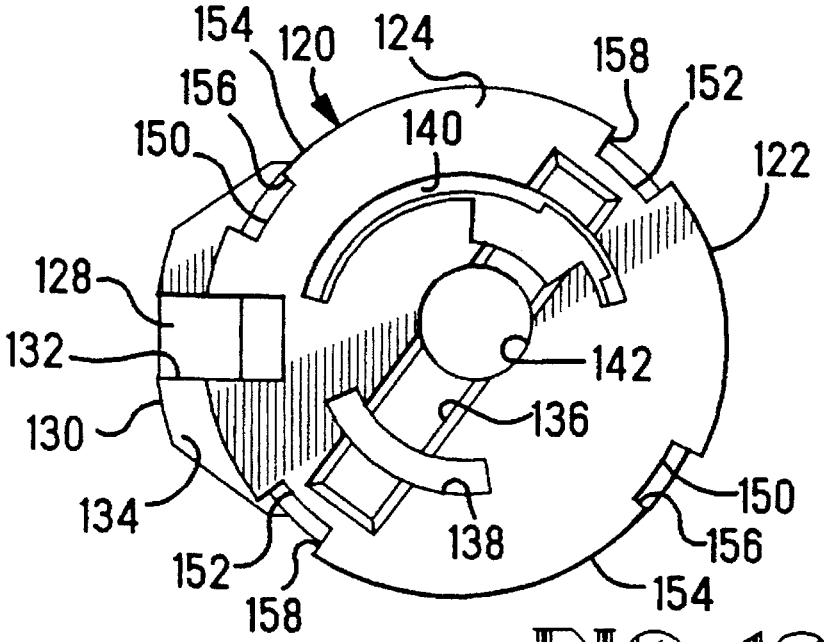

Camming surfaces 154 are defined on opposed sides of periphery 146 of actuator 120 adjacent top face 124, as seen in FIGS. 10 and 12. Camming surfaces 154 begin at initial portions adjacent reduced height side walls 156 of respective opposed first notches 150, and extend to terminal portions adjacent full height side walls 158 of second notches 152 with the terminal portions incrementally radially farther outward than the initial portions. Cap 190 is initially placed over actuator 120 with locking bosses 216 in notches 150. Upon rotation of cap 190 clockwise from a first position to a second position relative to the actuator and second terminal to terminate a secondary wire 220 (FIGS. 6 and 14), latch members 210 follow annular groove 148 while locking bosses 216 bear against camming surfaces 154 until reaching side walls 158 of respective notches 152, whereupon locking bosses 216 seat within notches 152 alongside side walls 158 and serve to prevent rotation of cap 190 in either counterclockwise (or further clockwise) direction with respect to actuator 120. However, cap member 190, second terminal 160 and actuator 120 can be rotated in a counterclockwise direction together from the second position to the first position relative to the silo, to unterminate a primary wire 112 from first terminal 60, by rotating cap 190 in a counterclockwise direction with use of a tool in tool-receiving slot 198. It can be seen that, during servicing that requires untermination of primary wire 112 such as for rerouting purposes, secondary wire 220 remaining terminated assures uninterrupted signal transmission service to the customer. With the particular embodiment of present invention disclosed herein, the secondary wires once terminated cannot be unterminated from second terminals 160.

It can be seen that variations and modifications may be made to the preferred embodiment disclosed herein that are within the spirit of the invention and the scope of the claims.

What is claimed is:

1. An electrical connector for connection of a secondary wire to a terminal in addition to connection of a primary wire thereto, comprising:

a housing defining a silo having a terminal-receiving cavity therein;

a first terminal disposed in said terminal-receiving cavity and including a contact section adapted to be terminated to a respective primary conductor wire;

an actuator movably affixed to said silo to enclose said first terminal therein, said actuator including a wire-receiving aperture thereinto aligned with said contact section of said first terminal, said actuator being movable from a first position to a second position with respect to said silo, and said actuator adapted to move one of a said primary wire and said first terminal to terminate them together in electrical engagement;

a second terminal mountable onto said actuator and including a first contact section adapted to be inserted through a respective first opening of said actuator to become electrically engaged with said first terminal, and further including a second contact section adapted to be terminated to a secondary conductor wire; and a cap affixed onto said actuator and enclosing said second terminal therewithin, said cap including a wire-receiving aperture thereinto aligned with said second contact section of said second terminal;

said cap and said actuator including cooperating locking sections permitting said cap to be moved in a first direction with respect to said actuator from a first position to a second position relative thereto, to terminate said secondary wire to said second terminal and engaging said locking sections locking said cap in a terminated position with respect to said actuator and said second terminal, and said actuator thereafter being movable in a second direction from said second position to said first position relative to said silo by movement of said cap thereon in said second direction, for untermination of said primary wire and carrying said second terminal and said secondary wire terminated thereto in said second direction, all while said secondary wire remains terminated to said second terminal and said first contact section of said second terminal remains in electrical engagement with said first terminal assuring an electrical connection of said secondary wire to said first terminal during untermination of said primary wire.

2. The connector as set forth in claim 1 wherein said silo includes a center post portion within said terminal-receiving cavity, with said center post portion joined to a cavity side wall by an isthmus, and said first terminal includes a gap axially therealong enabling said isthmus to be disposed in said gap upon full insertion of said first terminal into said terminal-receiving cavity of said silo.

3. The connector as set forth in claim 1 wherein said cap includes a plurality of latch members defined about a depending annular flange including upwardly facing latch surfaces, and said actuator includes a cooperating annular groove beneath a peripheral portion adjacent said top face and defining a downwardly facing surface cooperable with said latch surfaces securing said cap to said actuator when said latch members seat within said annular groove upon assembly of said cap onto said actuator, and permitting circumferential movement of said latch members in said annular groove permitting rotation of said cap with respect to said actuator.

4. The connector as set forth in claim 1 wherein said second terminal includes a lance angled inwardly at a top edge thereof, and said cap includes an inner cylindrical flange about which at least a top portion of said second terminal is disposed upon relative assembly together, said inner cylindrical flange including an inwardly directed recess enabling receipt thereinto of said lance upon first rotation in said first direction of said cap with respect to said second terminal from said first position to said second position, whereafter said cap and said second terminal are locked against relative rotation therebetween.

5. The connector as set forth in claim 1 wherein said cap includes locking bosses defined on actuator-proximate surfaces thereof cooperable with associated boss-receiving notches to seat therewithin upon said cap being first moved in said first direction, locking said cap and actuator in fixed angular relationship thereafter.

6. The connector as set forth in claim 1 wherein said actuator includes opposed first notches in a peripheral section about said top face adapted to receive thereinto locking bosses of said cap upon assembly of said cap to said actuator, and opposed second notches spaced angularly therefrom enabling locking receipt thereinto of said locking bosses of said cap upon rotation of said cap in said first direction from said first position to said second position with respect to said actuator.

7. The connector as set forth in claim 1 wherein said actuator is rotatable about an end of said silo in a first direction to urge one of said primary wire and said first terminal with respect to the other to terminate said primary wire to said first terminal, and said cap is rotatable about an end of said actuator in said first direction to urge one of said secondary wire and said second terminal with respect to the other to terminate said secondary wire to said second terminal.

8. The connector as set forth in claim 7 wherein said first contact section of said second terminal is a cantilever beam spring arm extending to a free end and having a contact surface thereon adapted to bear against surface of said first terminal when said second terminal is rotated with respect to said first terminal between first and second positions.

9. The connector as set forth in claim 8 wherein said second terminal includes a retention arm depending therefrom through a respective second opening of said actuator, to provide assured retention of said second terminal to said actuator.

10. The connector as set forth in claim 9 wherein said respective first opening and said respective second opening in said actuator coextend from a top face thereof, and said spring arm and said retention arm coextend from said second terminal, thus being exposed for insertion of both into said respective first opening and said respective second opening.

11. The connector as set forth in claim 10 wherein said peripheral section includes camming surfaces extending from each said opposed first notch to a respective said second notch, whereover said locking bosses ride during rotation of said cap in said first direction from said first position to said second position relative to said actuator, with each said camming surface extending from an initial portion adjacent said first notch to a terminal portion adjacent said second notch incrementally farther radially outwardly than said initial portion.

12. In a cross-connection of a service cable to a distribution cable for telecommunications transmission to a customer, a system for connection of secondary wires to the distribution cable in addition to connection of primary wires thereto, comprising:

a housing defining at least one pair of silos defining terminal-receiving cavities therein;

a pair of first terminals disposed in respective said terminal-receiving cavities, each including a first contact section adapted to be terminated to a respective conductor of a distribution cable and a second contact section adapted to be terminated to a respective primary conductor wire of a service cable;

a pair of actuators each movably affixed to respective said silos to enclose a said first terminal therein, each said actuator including a wire-receiving aperture thereinto aligned with said second contact section of said first terminal, each said actuator being movable from a first position to a second position relative to said silo, and each said actuator adapted to move one of a said primary wire and a said first terminal to terminate them together in electrical engagement;

a pair of second terminals mountable onto respective said actuators, each said second terminal including a first contact section adapted to be inserted through a respective opening of said actuator to become electrically engaged with a said first terminal, and further including a second contact section adapted to be terminated to a secondary conductor wire; and a pair of caps each affixed onto a respective said actuator and enclosing a respective said second terminal therewithin, each said cap including a wire-receiving aperture thereinto aligned with said second contact section of said second terminal;

each said cap and associated actuator including cooperating locking sections permitting said cap to be moved in a first direction with respect to said actuator from a first position to a second position relative thereto, to terminate a said secondary wire to said second terminal and engaging said locking sections locking said cap in a terminated position with respect to said actuator and said second terminal, and each said actuator thereafter being movable in a second direction from said second position to said first position relative to said silo by movement of said cap thereon in said second direction, for untermination of said primary wire and carrying said second terminal and said secondary wire terminated thereto in said second direction, all while said secondary wire remains terminated to said second terminal and said first contact section of said second terminal remains in electrical engagement with said first terminal assuring an electrical connection of said secondary wire to a corresponding conductor wire of said distribution cable during untermination of said primary wire.

13. In a cross-connection of a service cable to a distribution cable for telecommunications transmission to a customer, a system for connection of secondary wires to the distribution cable in addition to connection of primary wires thereto, comprising:

a housing defining at least one pair of silos defining terminal-receiving cavities therein;

a pair of first terminals disposed in respective said terminal-receiving cavities, each including a first contact section adapted to be terminated to a respective conductor of a distribution cable and a second contact section adapted to be terminated to a respective primary conductor wire of a service cable;

a pair of actuators each rotatably affixed to respective said silos to enclose a said first terminal therein, each said actuator including a wire-receiving aperture thereinto aligned with said second contact section of said first terminal, each said actuator being rotatable from a first position to a second position relative to said silo, and each said actuator adapted to move one of a primary wire and a said first terminal to terminate them together in electrical engagement;

a pair of second terminals mountable atop respective said actuators, each said second terminal including a first contact section adapted to be inserted through a respective slot of said actuator to become electrically engaged with a said first terminal, and further including a second contact section adapted to be terminated to a secondary conductor wire; and a pair of caps each affixed atop a respective said actuator and enclosing a respective said second terminal therewithin, each said cap including a wire-receiving aperture thereinto aligned with said second contact section of said second terminal;

each said cap and associated actuator including cooperating locking sections permitting said cap to be rotated in a first direction with respect to said actuator from a first position to a second position relative thereto, to terminate a said secondary wire to said second terminal and engaging said locking sections locking said cap in a terminated position with respect to said actuator and said second terminal, and each said actuator thereafter being rotatable in a second direction from said second position to said first position relative to said silo by rotation of said cap thereatop in said second direction, for untermination of said primary wire and carrying said second terminal and said secondary wire terminated thereto in said second direction, all while said secondary wire remains terminated to said second terminal and said first contact section of said second terminal remains in electrical engagement with said first terminal assuring an electrical connection of said secondary wire to a corresponding conductor wire of said distribution cable during untermination of said primary wire.

14. The system as set forth in claim 13 wherein said silo includes a center post portion within said terminal-receiving cavity, with said center post portion joined to a cavity side wall by an isthmus, and said first terminal includes a gap axially therealong enabling said isthmus to be disposed in said gap upon full insertion of said first terminal into said terminal-receiving cavity of said silo.

15. The system as set forth in claim 13 wherein said cap includes a plurality of latch members defined about a depending annular flange including upwardly facing latch surfaces, and said actuator includes a cooperating annular groove beneath a peripheral portion adjacent said top face and defining a downwardly facing surface cooperable with said latch surfaces securing said cap to said actuator when said latch members seat within said annular groove upon assembly of said cap onto said actuator, and permitting circumferential movement of said latch members in said annular groove permitting rotation of said cap with respect to said actuator.

16. The system as set forth in claim 13 wherein said second terminal includes a lance angled inwardly at a top edge thereof, and said cap includes an inner cylindrical flange about which at least a top portion of said second terminal is disposed upon relative assembly together, said inner cylindrical flange including an inwardly directed recess enabling receipt thereinto of said lance upon first rotation in said first direction of said cap with respect to said second terminal from said first position to said second position, whereafter said cap and said second terminal are locked against relative rotation therebetween.

17. The system as set forth in claim 13 wherein said cap includes locking bosses defined on actuator-proximate surfaces thereof cooperable with associated boss-receiving notches to seat therewithin upon said cap being first moved in said first direction, locking said cap and actuator in fixed angular relationship thereafter.

18. The system as set forth in claim 13 wherein said actuator includes opposed first notches in a peripheral section about said top face adapted to receive thereinto locking bosses of said cap upon assembly of said cap to said actuator, and opposed second notches spaced angularly therefrom enabling locking receipt thereinto of said locking bosses of said cap upon rotation of said cap in said first direction from said first position to said second position with respect to said actuator.

19. The system as set forth in claim 13 wherein said actuator is rotatable about an end of said silo in a first direction to urge one of said primary wire and said first terminal with respect to the other to terminate said primary wire to said first terminal, and said cap is rotatable about an end of said actuator in said first direction to urge one of said secondary wire and said second terminal with respect to the other to terminate said secondary wire to said second terminal.

20. The system as set forth in claim 19 wherein said first contact section of said second terminal is a cantilever beam spring arm extending to a free end and having a contact surface thereon adapted to bear against a surface of said first terminal when said second terminal is rotated with respect to said first terminal between first and second positions.

21. The system as set forth in claim 20 wherein said second terminal includes a retention arm depending therefrom through a respective second opening of said actuator, to provide assured retention of said second terminal to said actuator.

22. The system as set forth in claim 21 wherein said respective first opening and said respective second opening in said actuator coextend from a top face thereof, and said spring arm and said retention arm coextend from said second terminal, thus being exposed for insertion of both into said respective opening and said respective second opening.

23. The system as set forth in claim 22 wherein said peripheral section includes camming surfaces extending from each said opposed first notch to a respective said second notch, whereover said locking bosses ride during rotation of said cap in said first direction from said first position to said second position relative to said actuator, with each said camming surface extending from an initial portion adjacent said first notch to a terminal portion adjacent said second notch incrementally farther radially outwardly than said initial portion.

24. A cross-connection assembly for providing an array of cross-connection sites in close proximity to each other, comprising:

a plurality of housing modules each having a selected plurality of housing sections for respective electrical terminals permitting connection of conductors thereto; and a base frame providing a plurality of locations for respective ones of said housing modules and providing for securing of said housing modules thereto;

said base frame and said housing modules including cooperating polarizing sections permitting affixing of said housing modules to said base frame only in a particular orientation during assembly, assuring that said housing sections of each housing module are commonly oriented with respect to housing sections of other housing modules assembled to said base frame to facilitate later connection of said conductors to said terminals within said housing sections, all enabling modular assembly and facilitating selective disassembly of a particular housing module from said base frame during termination of conductors of a stub cable to respective said terminals to define a cable harness.

25. The assembly as set forth in claim 24 wherein an actuator is movably affixed atop each said housing section, and each said actuator includes a boss directly beneath a wire-receiving aperture thereof providing an upwardly facing wire-engageable surface including a groove in communication with said wire-receiving aperture of said actuator, enabling an end of a downwardly angled one of said primary wires to be directed into said wire-receiving aperture for termination.

26. The assembly as set forth in claim 24 wherein said base frame includes wire management fins at opposed first and second ends thereof, with horizontal tabs on each of said fins, and said horizontal tabs on said first end are located higher than said horizontal tabs on said second end, enabling horizontal tabs of a like said base frame to underlie said higher located horizontal tabs for close spacing of adjacent ones of said base frames.

27. The assembly as set forth in claim 24 wherein said polarizing sections of said base frame and said housing modules comprise horizontally extending tabs and associated tab-receiving recesses.

28. The assembly as set forth in claim 24 wherein each said housing module includes U-shaped grooves between adjacent ones of said housing sections, providing a generous wire management clearance.

29. The assembly as set forth in claim 24 wherein said base frame includes struts extending between upper edges of side walls between said housing module locations, providing support for said housing modules.

30. The assembly as set forth in claim 24 wherein each said housing module includes arcuate flanges depending beneath said base section adjacent respective arcuate slots and having wire-receiving slots thereinto aligned with associated wire-receiving slots in adjacent portions of said depending flanges, whereby said first contact sections of said first terminals inserted through respective said arcuate slots includes a wire-receiving slot between and aligned with said wire-receiving slots of said arcuate flanges and said depending flanges for said wires to be urged into said aligned slots for termination in said first contact section slot and strain relief by said arcuate flanges and depending flanges on both sides thereof.

31. The assembly as set forth in claim 24 wherein said housing modules include depending flanges extending beneath base sections thereof, and side walls of said base frame include flange-receiving slots extending vertically therealong from upper edges thereof for receipt of end edge portions of said depending flanges therealong during assembly of said housing modules to said base frame.

32. The assembly as set forth in claim 31 wherein said end edges of said depending flanges dimensioned to be force fit into respective said flange-receiving slots, providing retention of said housing modules to said base frame.

* * * * *